United States Patent [19]

Inui

[11] 4,301,607

[45] Nov. 24, 1981

[54] HYDRAULIC EXCAVATOR

[75] Inventor: Takayasu Inui, Osaka, Japan

[73] Assignee: Kabushiki Kaisha Komatsu Seisakusho, Tokyo, Japan

[21] Appl. No.: 139,336

[22] Filed: Apr. 11, 1980

[30] Foreign Application Priority Data

Apr. 18, 1979 [JP] Japan ..... 54-50699[U]

[51] Int. Cl.[3] ..... E02F 3/32

[52] U.S. Cl. ..... 37/118 R; 414/722

[58] Field of Search ..... 37/103, 117.5, 118 R; 414/685, 687, 688, 722, 723

[56] References Cited

U.S. PATENT DOCUMENTS

| | | | |
|---|---|---|---|
| 3,583,585 | 6/1971 | Joyce | 37/103 X |
| 3,584,751 | 6/1971 | Bellart | 37/103 X |
| 3,862,697 | 1/1975 | Gill et al. | 37/118 R X |
| 3,927,781 | 12/1975 | Okabe | 37/118 R X |
| 4,077,140 | 3/1978 | Branconi | 37/103 |
| 4,171,054 | 10/1979 | Tanaka et al. | 37/103 X |
| 4,218,837 | 8/1980 | Peterman | 414/685 X |

FOREIGN PATENT DOCUMENTS

| | | | |
|---|---|---|---|
| 2511819 | 9/1976 | Fed. Rep. of Germany | 37/103 |
| 118342 | 1/1956 | U.S.S.R. | 37/103 |

*Primary Examiner*—E. H. Eickholt

*Attorney, Agent, or Firm*—Armstrong, Nikaido, Marmelstein & Kubovcik

[57] ABSTRACT

A hydraulic excavator comprising a vehicle, a boom pivotally connected at one end to the vehicle, a stick pivotally connected at one end to the other end of the boom, a bucket pivotally connected to the other end of the stick. A bucket attitude maintaining arrangement is provided to maintain a substantially fixed preselected attitude of the bucket with respect to the ground upon movement of the stick about its pivotal connection to the boom. The bucket attitude maintaining arrangement includes a lever pivotally mounted at one end to the stick and a compensating cylinder pivotally connected at one end to the stick and at the other end to the lever.

3 Claims, 4 Drawing Figures

HYDRAULIC EXCAVATOR

BACKGROUND OF THE INVENTION

This invention relates to earthmovers, to excavators, and in particular to a hydraulically-actuated excavator of the front-loading, level-crowding variety.

The implement assembly of a front-loading hydraulic excavator, mounted on a full-revolving carrier of the trunk or wheel type, normally comprises a boom pivoted at one end on the vehicle, a stick pivotally connected at one end to the outer or front end of the boom, and a front-loading or front-opening bucket pivotally mounted on the other end of the stick. A hydraulic jack or jacks under operator control are provided for operation of each of the boom, the stick, and the bucket.

The excavator applies power to the bucket for cutting and the like solely through the manipulation of linkages, with the vehicle normally kept in a stationary position. This is in contrast to the usual loader machine wherein power is applied to the bucket for loading purposes by translation of the vehicle itself along the ground. In other words, power is applied to the excavator bucket by means of hydraulically operated linkages, whereas power is applied to the loader type bucket by means of the driving wheels of the vehicle.

Thus, the movement of the bucket in an excavator is controlled during its operation through the manipulation of the linkage system.

The application of power to the bucket by means of the linkage system requires careful and precise control of the linkage itself in order to achieve proper manipulation of the bucket. To achieve operations requiring a substantially level cut, all hydraulic jacks must be manipulated simultaneously by the operator. This requires diligence, experience and concentration by the operator. Such diligence and concentration hasten the fatique of the operator, resulting in his inefficient handling of this operation.

The prior art approach to bucket level control during crowding movement of the stick is disclosed in U.S. Pat. Nos. 3,862,697 and 3,927,781.

SUMMARY OF THE INVENTION

It is an object of the present invention to provide a hydraulic excavator linkage system which is capable of effecting a level cut automatically during the crowding movement of the excavator stick.

Another object of the present invention is to provide a hydraulic excavator linkage system that is operative to maintain bucket attitude control automatically during crowding movement of the excavator stick by only manipulating crowd jack means.

In accordance with an aspect of the present invention, there is provided a hydraulic excavator, comprising: a vehicle having a mobile carriage and a rotary platform supported on said carriage; a boom pivotally supported at one end on said rotary platform for movement about a horizontal axis; a stick piotally connected at one end to the outer end of said boom; a bucket pivotally connected to the other end of said stick; hoist jack means pivotally connected at one end to the rotary platform of said vehicle and at the other end to said boom, said hoist jack means having a rod end and a head end chambers formed therein; crowd jack means pivotally connected at one end to the rotary platform of said vehicle and at the other end to said stick; a lever pivotally mounted at one end on said stick for movement in a vertical plane; a link pivotally connected at one end to said boom and at the other end to said lever; bucket jack means pivotally connected at one end to said lever and at the other end to said bucket for controlling the attitude of said bucket; and compensating cylinder means pivotally connected at one end to said lever and at the other end to said stick, said compensating cylinder means having a rod end and a head end chambers formed therein wherein the rod end chamber of said compensating cylinder means is communicated with the rod end chamber of said hoist jack means and the head end chamber of said compensating cylinder means is communicated with the head end chamber of said hoist jack means.

The above and other objects, features and advantages of the present invention will be readily apparent from the following description taken in conjunction with the accompanying drawings.

DESCRIPTION OF THE PREFERRED EMBODIMENT

Figure 1:
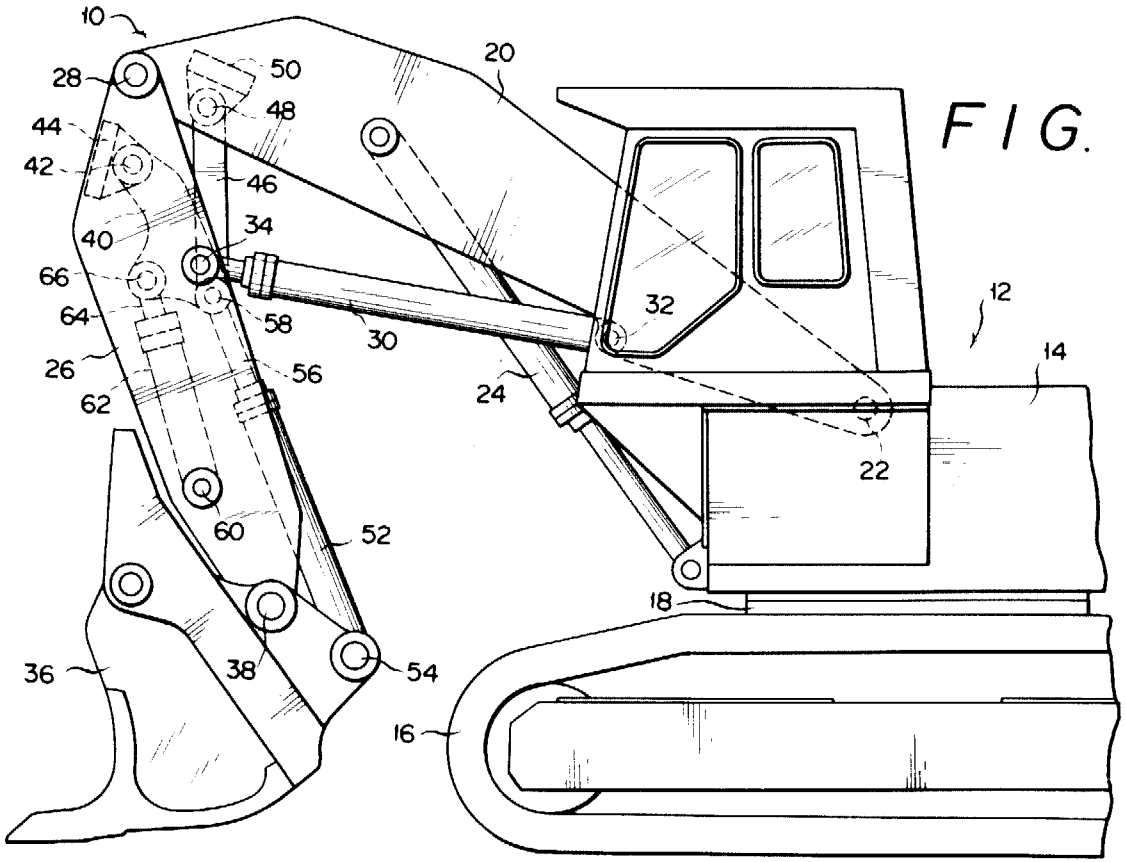
FIG. 1 is a side elevational view of an excavator embodying the linkage and control means of the present invention with the linkage shown in the fully retracted position.
Figure 2:
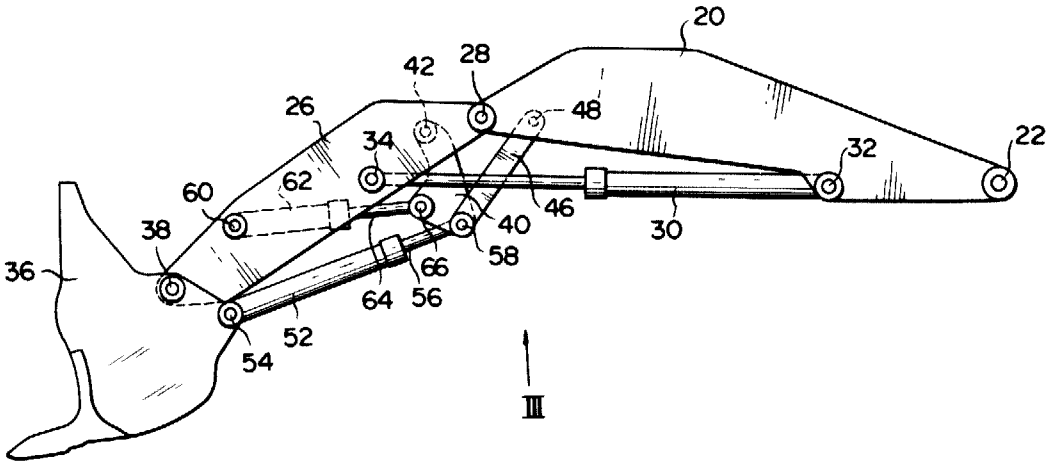
FIG. 2 is a side elevational view of an excavator showing the linkage in the fully extended position with the vehicle being omitted.

The present invention will now be described in detail with reference to the accompanying drawings. Referring to FIG. 1, there is illustrated a bucket actuating linkage generally designated by the numeral 10, operatively supported on a vehicle 12 to form a hydraulic excavator which further comprises an upper frame or platform 14 rotatably mounted on a track under carriage 16 by suitable bearing means 18.

The bucket actuating linkage comprises a boom 20 having one end pivotally connected to the frame at 22, with a pair of hydraulic hoist or lift jacks 24 operatively connected between the frame and the boom for controlling the pivotal movement of the boom 20 about pivot 22. The bucket linkage includes a stick or arm 26 having one end pivotally connected at 28 to the outer end of the boom 20 and movable about the pivot 28 by a pair of hydraulic crowd jacks 30, pivotally connected to the frame at 32 and to the stick at 34.

Figure 3:
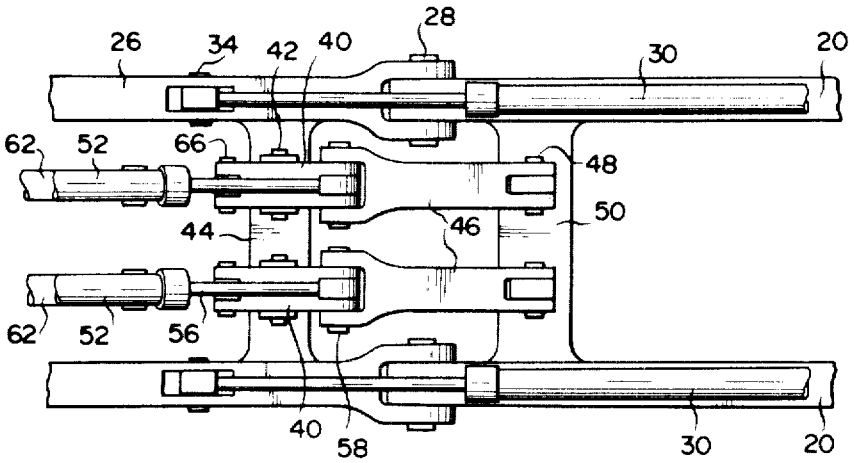
FIG. 3 is a view as seen from an arrow III of FIG. 2.

A bucket 36 is pivotally mounted at 38 to the lower end of the stick 26. A pair of levers or bellcranks 40 are pivotally mounted at 42 on a strut 44, which in turn is fixedly secured to and sandwiched by the stick 26. A pair of links or yokes 46 are pivotally mounted at 48 on a strut 50, which in turn is fixedly secured to and sandwiched by the boom 20 (FIG. 3).

The bucket 36 is controlled in its pivotal movement about pivot mount 38 by a pair of spaced hydraulic bucket control jacks 52 pivotally connected to the bucket 36 at a pivot 54. Piston rods 56 of the bucket jacks 52 are pivotally connected at 58 to the lower end portion of the levers 40. The other ends or lower ends of the links 46 are also pivotally connected at 58 to the levers 40. Therefore connection points of the bucket jacks 52 and the links 46 to the levers 40 share the common axis.

Pivotally connected at 60 to the stick 26 are a pair of compensating cylinders 62, piston rods 64 of which are pivotally connected to the levers 40 at 66.

Figure 4:
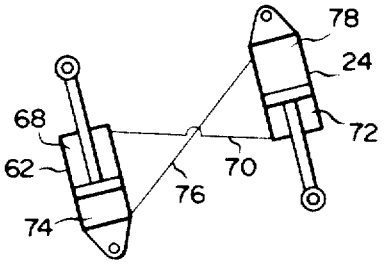
FIG. 4 is a schematic explanational view showing how the hoist jack and the compensating cylinder is communicated with each other.

Referring now to FIG. 4 showing a connection between the hoist jacks and the compensating cylinders, a rod end chamber 68 of each the compensating cylinder 62 communicates through a conduit 70 with a rod end chamber 72 of each the hoist jack 24 and a head end chamber 74 of each the compensating cylinder 62 communicates through a conduit 76 with a head end chamber 78 of each the hoist jack 24.

The operation of the present invention will now be described below.

At the start of the dig operation, the bucket actuating linkage 10 and the bucket 36 are positioned as shown in FIG. 1. The crowd jacks 30 are then extended, causing the stick 26 to pivot at 28 and the bucket 36 to move forwardly. The bucket control jacks 52 act substantially as solid links during this phase, and cause the bucket to rotate couter-clockwise about pivot 38 such that the bucket remains substantially level.

As the stick 26 is extended forwardly, the compensating cylinders 62 are also extended, causing the fluid in the rod end chambers 68 of the compensating cylinders 62 to flow into the rod end chambers 72 of the hoist jacks 24. As a result, the hoist jacks 24 are retracted and hence the boom 20 is lowered. Therefore by merely operating the crowd jacks 30, the linkage 10 including the boom 20 and the stick 26 is automatically controlled so as to maintain the bucket 36 to remain substantially level during the crowding movement of the excavator stick.

While a single embodiment of the invention has been shown and described herein, it is to be understood that the embodiment is illustrative only and not to be taken a definition of the scope of the invention, reference being made for this purpose to the appended claims.

What I claim is:

1. A hydraulic excavator, comprising:

a vehicle having a mobile carriage and a rotary platform supported on said carriage;

a boom pivotally support at one end on said rotary platform for movement about a horizontal axis;

a stick pivotally connected at one end to the outer end of said boom;

a bucket pivotally connected to the other end of said stick;

hoist jack means pivotally connected at one end to the rotary platform of said vehicle and at the other end to said boom, said hoist jack means having a rod end and a head end chambers formed therein;

crowd jack means pivotally connected at one end to said boom and at the other end to said stick;

a lever pivotally mounted at one end on said stick for movement in a vertical plane;

a link pivotally connected at one end to said boom and at the other end to said lever;

bucket jack means pivotally connected at one end to said lever and at the other end to said bucket for controlling the attitude of said bucket; and compensating cylinder means pivotally connected at one end to said lever and at the other end to said stick, said compensating cylinder means having a rod end and a head end chambers formed therein wherein the rod end chamber of said compensating cylinder means is communicated with the rod end chamber of said hoist jack means and the head end chamber of said compensating cylinder means is communicated with the head end chamber of said hoist jack means.

2. A hydraulic excavator as recited in claim 1 wherein pivotal connections of said link and said bucket jack means to said lever share a common axis.

3. A hydraulic excavator as recited in claim 1 or 2 wherein said hoist jack means comprises a pair of hydraulic jacks each having a rod end pivotally connected to said rotary platform and said compensating cylinder means comprises a pair of hydraulic cylinders each having a rod end pivotally connected to said lever.

* * * * *